US007594399B2

(12) United States Patent
Lehar et al.

(10) Patent No.: US 7,594,399 B2
(45) Date of Patent: Sep. 29, 2009

(54) SYSTEM AND METHOD FOR POWER GENERATION IN RANKINE CYCLE

(75) Inventors: Matthew Alexander Lehar, Bavaria (DE); Joerg Stromberger, Buechenbach (DE); Thomas Johannes Frey, Bavaria (DE); Gabor Ast, Bavaria (DE); Michael Bartlett, Bayern (DE)

(73) Assignee: General Electric Company, Niskayuna, NY (US)

( * ) Notice: Subject to any disclaimer, the term of this patent is extended or adjusted under 35 U.S.C. 154(b) by 345 days.

(21) Appl. No.: 11/609,919

(22) Filed: Dec. 13, 2006

(65) Prior Publication Data

US 2008/0141673 A1 Jun. 19, 2008

(51) Int. Cl.
*F01K 25/06* (2006.01)

(52) U.S. Cl. ..... 60/649

(58) Field of Classification Search ..... 60/649
See application file for complete search history.

(56) References Cited

U.S. PATENT DOCUMENTS 4,016,724 A * 4/1977 Karlsson ..... 60/672
4,084,379 A * 4/1978 Schwartzman ..... 60/641.3
4,249,385 A * 2/1981 Bissell ..... 60/674
4,440,601 A * 4/1984 Katz et al. ..... 203/24
5,131,231 A * 7/1992 Trimble et al. ..... 60/649
6,263,675 B1 * 7/2001 Hansen et al. ..... 60/649
2006/0196187 A1 9/2006 Zimron et al.

FOREIGN PATENT DOCUMENTS

WO WO2005085398 A2 9/2005
WO WO2006014609 A2 2/2006

* cited by examiner

*Primary Examiner*—Hoang M Nguyen
(74) *Attorney, Agent, or Firm*—Ann M. Agosti

(57) ABSTRACT

A system for power generation includes a boiler configured to receive heat from an external source and a liquid stream and to generate a vapor stream. The liquid stream comprises a mixture of at least two liquids. The system also includes an expander configured to receive the vapor stream and to generate power and an expanded stream. A condenser is configured to receive the expanded stream and to generate the liquid stream. The system further includes a supply system coupled to the boiler or the condenser and configured to control relative concentration of the two liquids in the liquid stream.

18 Claims, 5 Drawing Sheets

SYSTEM AND METHOD FOR POWER GENERATION IN RANKINE CYCLE

BACKGROUND

This invention relates generally to power generation systems using a Rankine cycle. More particularly this invention relates to power generation systems using a Rankine cycle with a mixture of at least two liquids as the working fluid.

Rankine Cycles use a working fluid in a closed cycle to gather heat from a heating source or a hot reservoir by generating a hot gaseous stream that expands through a turbine to generate power. The expanded stream is condensed in a condenser by rejecting the heat to a cold reservoir. The working fluid in a Rankine cycle follows a closed loop and is re-used constantly. The efficiency of Rankine Cycles such as Organic Rankine Cycles (ORCs) in a low-temperature heat recovery application is very sensitive to the temperatures of the hot and cold reservoirs between which they operate. In many cases, these temperatures change significantly during the lifetime of the plant. Geothermal plants, for example, may be designed for a particular temperature of geothermal heating fluid from the earth, but lose efficiency as the ground fluid cools over time, thereby shifting the plant operating temperature away from its design point. Air-cooled ORC plants that use an exhaust at a constant-temperature from a larger plant as their heating fluid will still deviate from their design operating conditions as the outside air temperature changes with the seasons or even between morning and evening.

Therefore there is a need for a power generation system using a Rankine Cycle that can deal with fluctuations in the temperature of the hot and cold reservoir or heat sources without adversely affecting the efficiency or the stability of the power generation system.

BRIEF DESCRIPTION

In one aspect, a system for power generation includes a boiler configured to receive heat from an external source and a liquid stream and to generate a vapor stream. The liquid stream comprises a mixture of at least two liquids. The system also includes an expander configured to receive the vapor stream and to generate power and an expanded stream. A condenser is configured to receive the expanded stream and to generate the liquid stream. The system further includes a supply system coupled to the boiler or the condenser and configured to control relative concentration of the two liquids in the liquid stream.

In another aspect, a system for power generation includes a boiler configured to receive heat from an external source and a liquid stream and to generate a vapor stream, wherein said liquid stream comprises a mixture of at least two liquids. The system also includes an expander configured to receive the vapor stream and to generate power and an expanded stream and a condenser configured to receive the expanded stream and generate the liquid stream. A supply system is coupled to one of the boiler or condenser and is configured to control relative concentration of the two liquids in the liquid stream. The supply system includes a first tank to hold a liquid rich in said higher boiling point liquid and a second tank to hold a liquid rich in lower boiling point liquid.

In yet another aspect, a method of controlling a power generation system includes a boiler configured to receive a liquid stream and to generate a vapor stream, an expander configured to receive the vapor stream and to generate an expanded stream, and a condenser configured to receive the expanded stream and to generate the liquid stream. The method includes controlling relative concentration of at least two liquids in the liquid stream using a supply system coupled to the boiler or the condenser to supply a stream rich in one of the two liquids.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
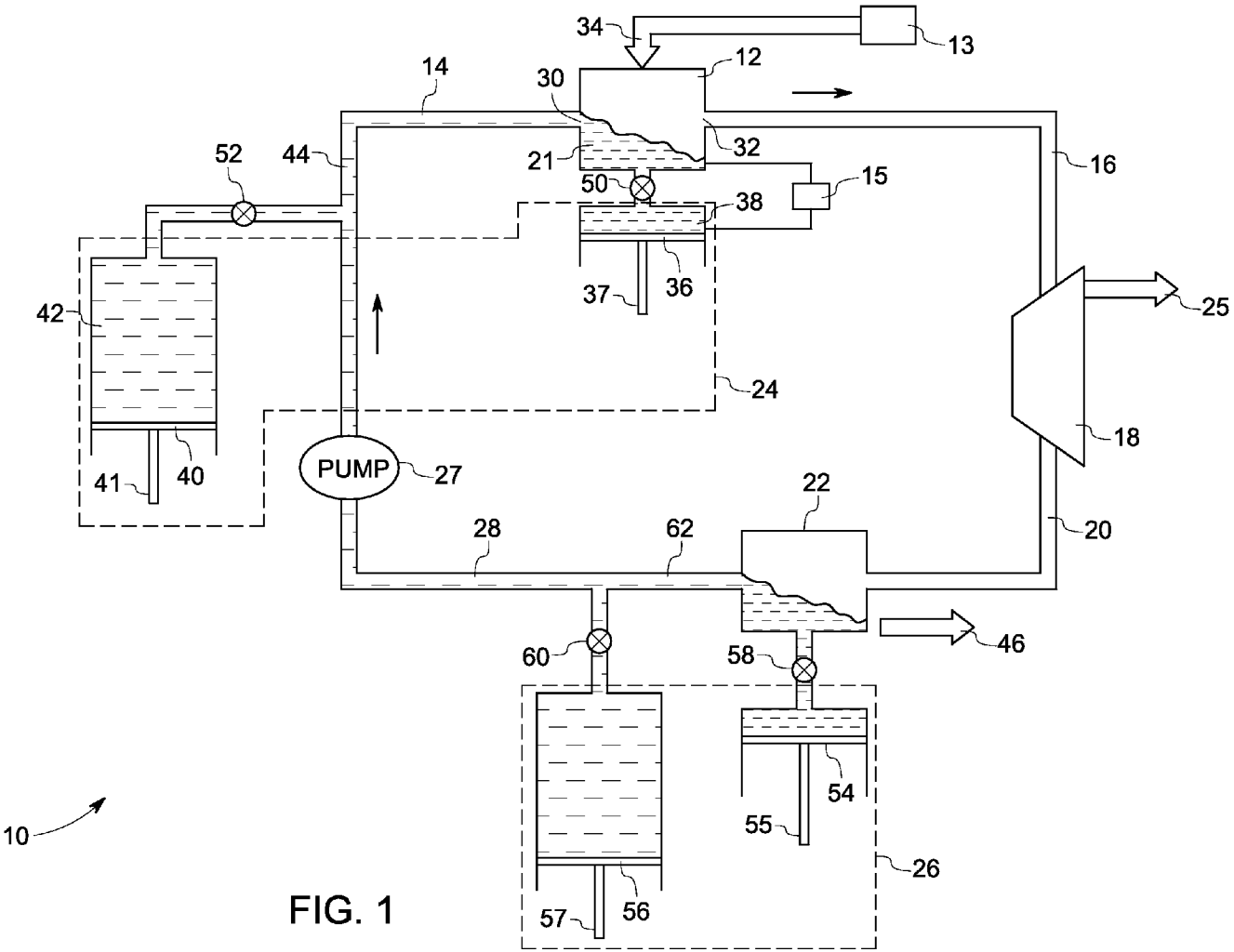
FIG. 1 illustrates an exemplary power generation system using a Rankine Cycle.

FIG. 1 represents an exemplary system 10 for power generation using a Rankine Cycle. The system includes a boiler 12 configured to receive heat from an external source 13 and a liquid stream 14 and to generate a vapor stream 16. The power generation system 10 also includes an expander 18 configured to receive the vapor stream 16 and to generate power 25 by rotating the mechanical shaft (not shown) of the expander 18 and an expanded stream 20. A condenser 22 is configured to receive the expanded stream 20 and to generate the liquid stream 14. A supply system is coupled to the boiler 12 or the condenser 22 (with the "or" as used herein meaning either or both) and is configured to control relative concentration of the two liquids in the liquid stream 14 and the vapor stream 16. The liquid stream 14 and the vapor stream 16 along with the vapor and liquid phase within the boiler 12 and condenser 22 form the working fluid of the Rankine cycle shown in FIG. 1.

The power generation system using a Rankine Cycle plant shown in FIG. 1 uses a working fluid comprising a mixture of two or more component fluids, in place of a single pure substance. By the adjustment of the relative quantities of each component of the fluid, the properties of working fluid as a whole may be varied to accommodate changes in the external temperature conditions, as described below. In a Rankine cycle, the working fluid is pumped (ideally isentropically) from a low pressure to a high pressure by a pump 27 as shown in FIG. 1. Pumping the working fluid from a low pressure to a high pressure requires a power input (for example mechanical or electrical). The high-pressure liquid stream 14 enters the boiler 12 where it is heated at constant pressure by an external heat source 13 to become a saturated vapor stream 16. Common heat sources for organic Rankine cycles are exhaust gases from combustion systems (power plants or industrial processes), hot liquid or gaseous streams from industrial processes or renewable thermal sources such as geothermal or solar thermal. The superheated or saturated vapor stream 16 expands through the expander 18 to generate power output (as shown by the arrow 25). In one embodiment, this expansion is isentropic. The expansion decreases the temperature and pressure of the vapor stream 16. The vapor stream 16 then enters the condenser 22 where it is cooled to generate the saturated liquid stream 28. This saturated liquid stream 28 re-enters the pump 27 to generate the liquid stream 14 and the cycle repeats.

As described above, the power generation system 10 represents a Rankine cycle where the heat input is obtained through the boiler 12 and the heat output is taken from the condenser 22. In operation, the boiler 12 is connected to an inlet 30 and outlet 32. The arrow 34 indicates the heat input into the boiler from the external heat source 13 and the arrow 46 indicates the heat output from the condenser 22 to the cold reservoir. In some embodiments, the cold reservoir is the ambient air and the condenser is an air-cooled condenser. In some embodiments, the liquid stream 14 comprises two liquids namely a higher boiling point liquid and a lower boiling point liquid. Embodiments of the boiler 12 and the condenser 22 can include an array of tubular, plate or spiral heat exchangers with the hot and cold fluid separated by metal walls.

To control the boiling and condensing characteristics of a mixture of two fluids in a thermodynamic cycle, the supply systems described herein actively manipulate the ratio of fluid concentrations. The method described herein uses the boiling and/or condensing stages that belong to any Rankine cycle as a means of changing the relative concentrations of the two fluids. After the point in the Rankine cycle where boiling or condensation has begun, but before the point where it completes (producing a vapor and liquid, respectively), two phases exist simultaneously in the boiler/condenser. The liquid phase, when compared with the homogeneous single-phase mixture, necessarily contains a higher concentration of the mixture species with the higher boiling point. The system and the methods described herein propose to change the overall concentrations of the working fluid by removing some of this liquid from the section of the boiler 12 or the condenser 22, where the two phases coexist.

As shown in FIG. 1, the first supply system 24 includes a first tank 36 configured to hold and supply a first fluid 38 rich in higher boiling point liquid. The first supply system 24 may further include a second tank 40 coupled to the inlet line 44 to the boiler 12 configured to hold and supply a second fluid 42 rich in lower boiling point liquid. The first tank 36 is fluidically coupled to the boiler 12 through a valve 50 and the second tank 40 is fluidically coupled to the inlet line 44 of the boiler 12 through a valve 52. The condenser 22 may be coupled to a second supply system 26. The second supply system 26 includes a first tank 54 fluidically coupled to the condenser 22 through a valve 58 and a second tank 56, fluidically coupled to the outlet 62 of the condenser 22 through a valve 60. Although the embodiment shown in FIG. 1 includes two supply systems 24 and 26 coupled to the boiler 12 and the condenser 22 respectively, alternate embodiments may include a single supply system coupled to either the boiler 12 or the condenser 22.

Figure 2:
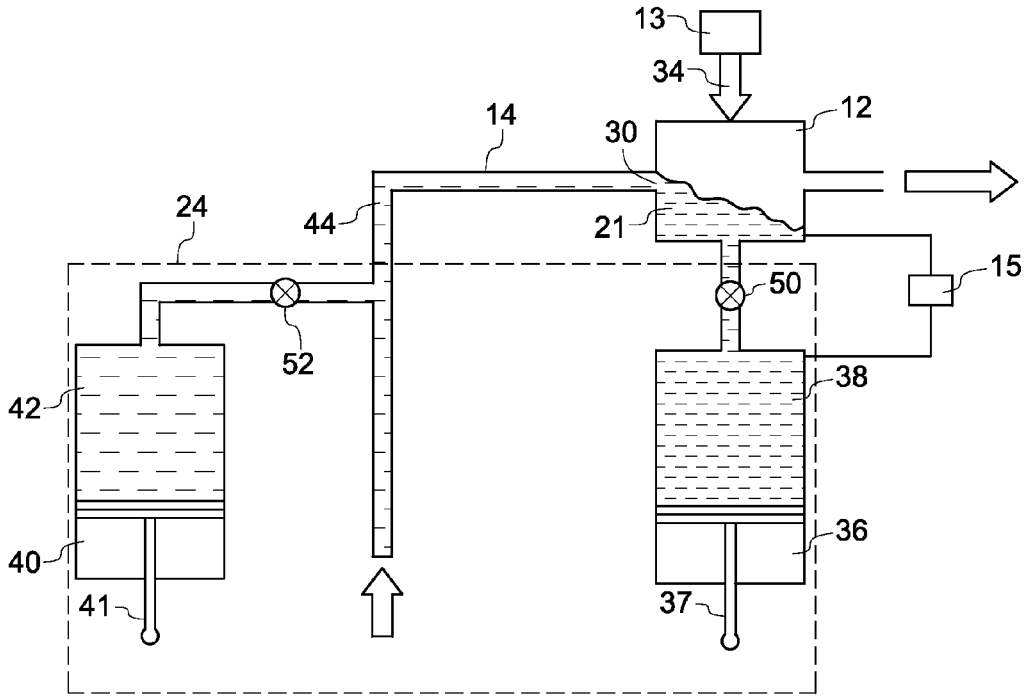
FIG. 2 illustrates the normal operation of the boiler of the exemplary power generation system of FIG. 1.
Figure 3:
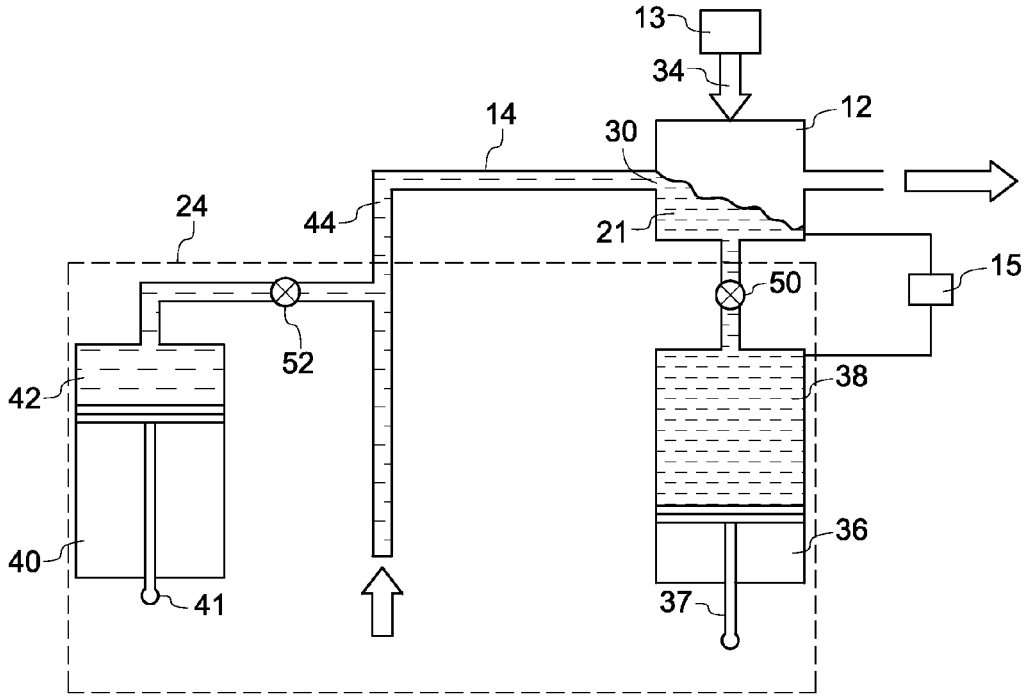
FIG. 3 illustrates the operation of the boiler of the exemplary power generation system of FIG. 1 when the temperature of the external heat source is low.

FIG. 2 illustrates the normal operation of the boiler 12 along with the first supply system 24 coupled to the boiler 12. When the temperature of the heat source 13 remains stable during operation, the valves 50 and 52 connected to the first tank 36 and the second tank 40 respectively remain closed and the first supply system 24 is not fluidically coupled to the boiler. FIG. 3 illustrates the operation of the boiler 12 when the temperature of the external source 13 is lower than that during normal operation as shown in FIG. 2. When the temperature of the external source is low, the valve 52 attached to the second tank 40 opens to allow the fluid 42 rich in the lower boiling point liquid to be supplied into the inlet line 44 of the boiler 12. Simultaneously, to keep the entire volume of working fluid inside the cycle constant, the valve 50 opens and pulls back equivalent amount of the liquid 38 rich in higher boiling point liquid from the boiler 12. Since the liquid 21 inside the boiler 12 gets richer in the lower boiling point liquid, heat is removed more effectively from the heat source 13 at lower temperature. This boosts the power output of the cycle, hence regaining a portion of the power output lost compared to the design point.

Figure 4:
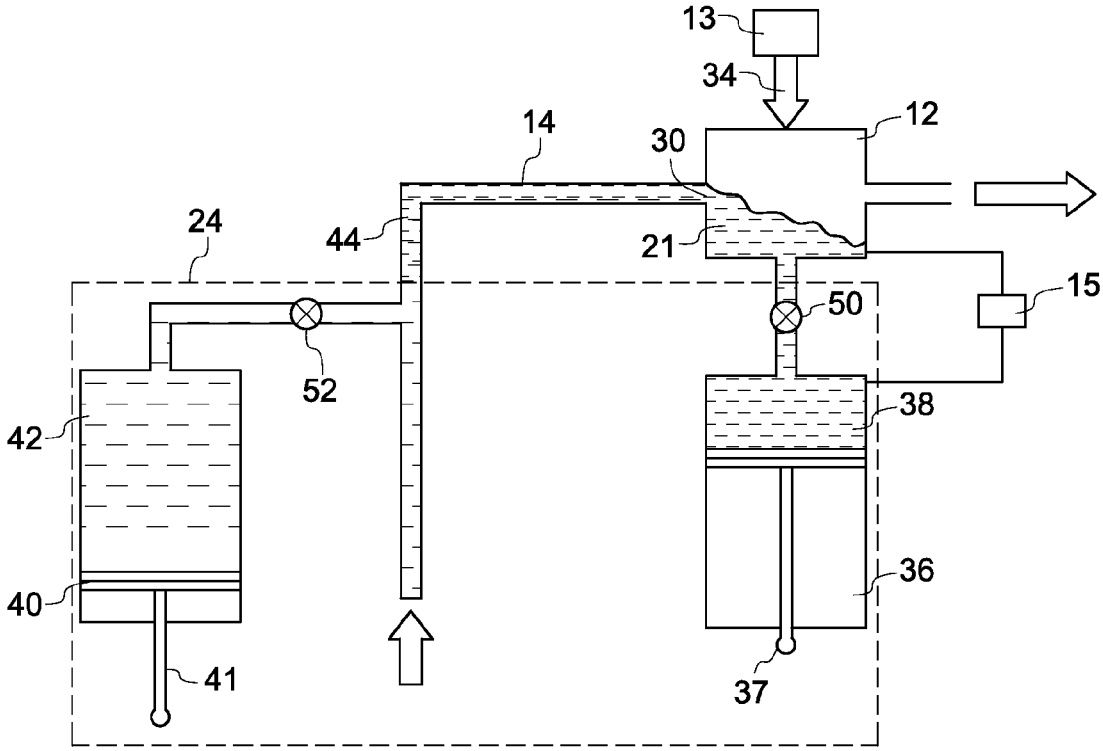
FIG. 4 illustrates the operation of the boiler of the exemplary power generation system of FIG. 1 when the temperature of the external heat source is high.

FIG. 4 illustrates the operation of the boiler 12 when the temperature of the external source 13 is too high. In order to maximize the power generation level, the supply system 24 operates in such a way that heat is removed more effectively from the heat source. In order to achieve that, the mixture rich in lower boiling point liquid 42 is pulled back into the first tank 40 and the same volume of liquid rich in higher boiling point liquid 38 is pushed into the boiler 12. Therefore the liquid mixture 21 in the boiler 12 is richer in the higher boiler point liquid and keeps the temperature and the amount of vapor generated in the boiler 12 optimal in spite of an increase in the temperature of the external source. As shown in FIG. 1, a controller 15 is electrically coupled to the boiler 12 and the supply system 24 configured to provide the signals for the opening and closing of the valves 50 and 52. The working fluid may be pulled into the cycle and out of it by plungers 37 and 41 of the first supply system 24 and plungers 55 and 57 of the second supply system 26. The plunger operations are governed by electric motors (not shown).

Although the working fluid is described herein as a mixture of a higher boiling point liquid and a lower boiling point liquid, the working fluid may also include more than two components. In some embodiments, the working fluid is a mixture of water and an alcohol. In one embodiment, the mixture comprises water and ethanol. In some other embodiments, the working fluid may include more than one hydrocarbon. In one embodiment, the working fluid comprises at least two of alkanes such as pentane, propane, cyclohexane, cyclopentane and butane. In some embodiments, the working fluid may also include fluorohydrocarbons, ketones and aromatics.

Figure 5:
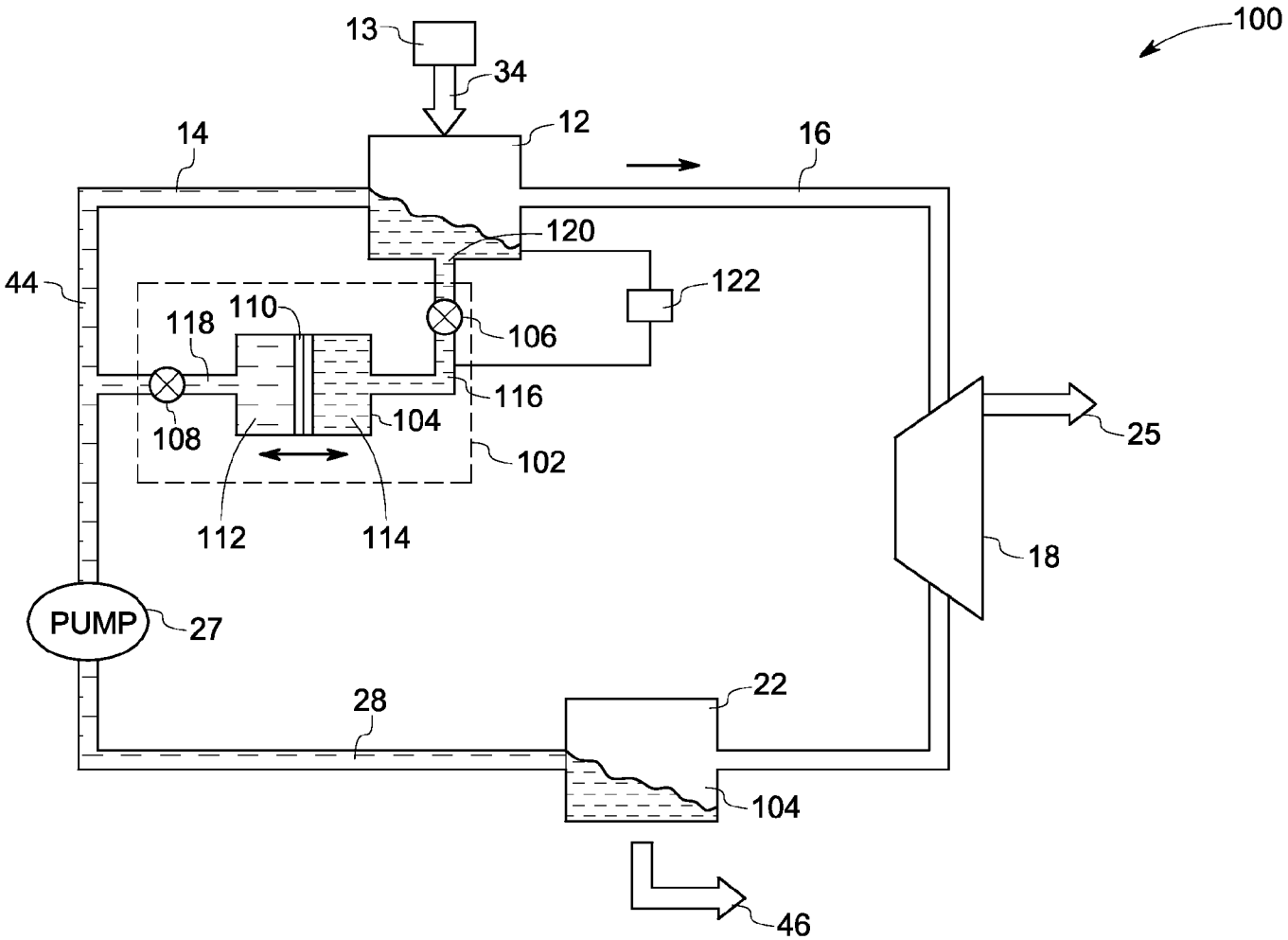
FIG. 5 illustrates another exemplary power generation system using a Rankine cycle.

FIG. 5 illustrates another exemplary power generation system 100, wherein the supply system 102 comprises a single chamber 104 and a movable barrier 110 situated in the chamber 104. The movable barrier 110 is configured to separate two liquids: one rich in lower boiling point liquid 112 and another rich in higher boiling point liquid 114. As shown in FIG. 5, the operation of the boiler 12 is illustrated using such a single chamber 104. The two outlets 116 and 118 of the chamber 104 are attached to valves 106 and 108. The liquid rich in higher boiling point liquid 114 is directly coupled to the boiler 12 through an inlet 120. The liquid rich in lower boiling point liquid 112 is coupled to the inlet line 44 to the boiler 12. In operation, when the temperature of the external source 13 is low, the movable barrier 110 is configured to move towards the valve 108 to push more liquid rich in lower boiling point 112 to maximize the amount of heat recovered. Simultaneously, the liquid rich in higher boiling point 114 is pulled back into the single chamber 104 through the opening of the valve 106 to keep the volume of the working fluid in the system constant. Alternatively, when the temperature of the external source 13 is too high, the movable barrier 110 is configured to move towards the valve 106 to push more liquid rich in higher boiling point 114 maximize the amount of heat recovered. Simultaneously, the liquid rich in lower boiling point 112 is pulled back into the single chamber 104 through the opening of the valve 108 to keep the volume of the working fluid in the system constant. As shown in FIG. 5, a controller 122 is electrically coupled to the boiler 12, the heat source 13, and the supply system 102 configured to provide the signals for the opening and closing of the valves 106, 108 and the movement of the movable barrier 110.

Figure 6:
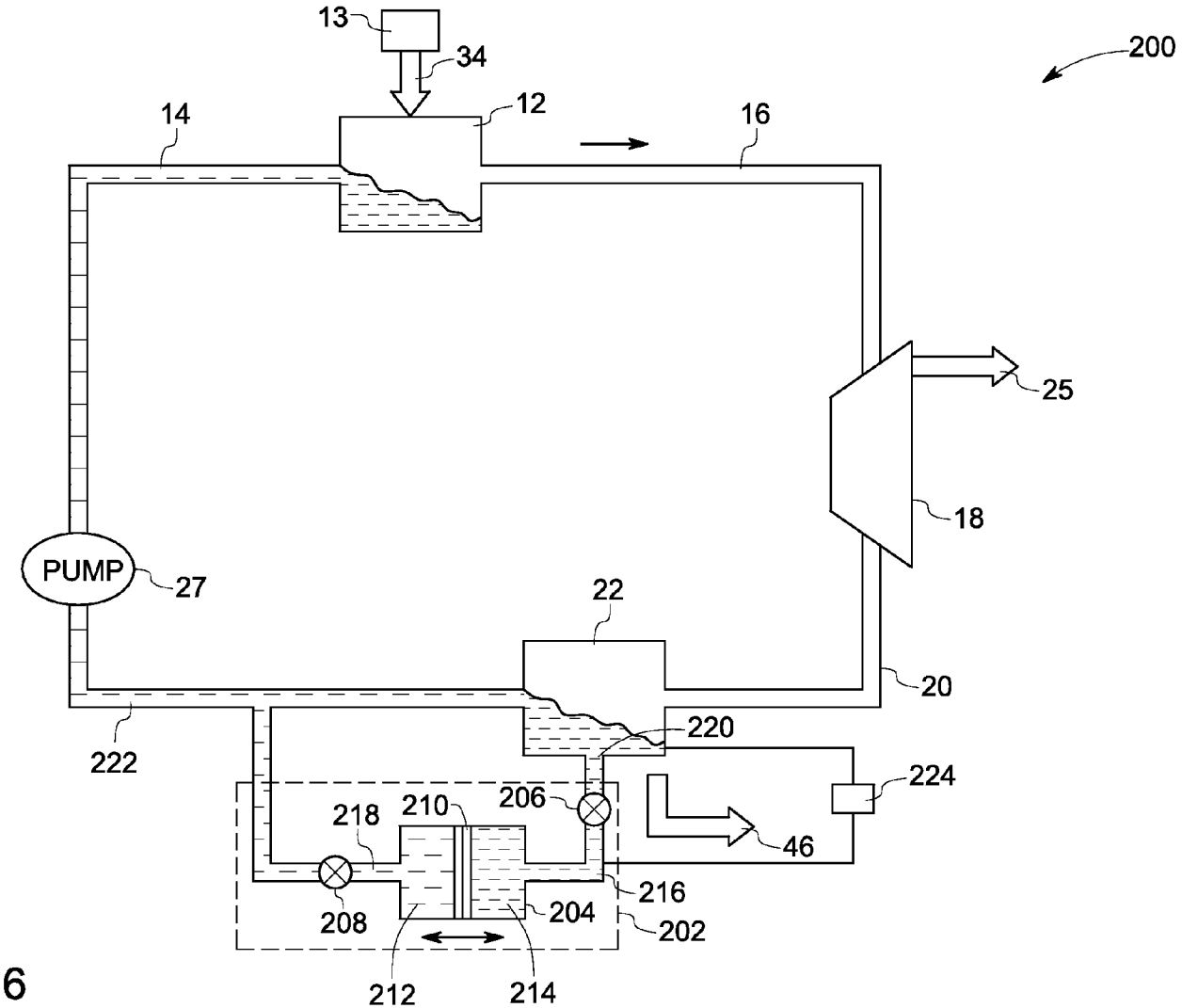
FIG. 6 illustrates yet another exemplary power generation system using a Rankine cycle.

FIG. 6 illustrates the operation of the condenser 22 connected to a supply system 202, wherein the supply system 202 includes a single chamber 204 and a movable barrier 210 situated in the chamber 204. As described earlier, the movable barrier 210 is configured to separate two liquids one rich in lower boiling point liquid and another rich in higher boiling point liquid. As shown in FIG. 6, the operation of the condenser 22 is illustrated using such a single chamber 204. The two outlets 216 and 218 of the chamber 204 are attached to valves 206 and 208 respectively. The liquid rich in higher boiling point liquid 214 is directly coupled to the condenser 22 through an inlet 220. The liquid rich in lower boiling point liquid 212 is coupled to the outlet 222 to the condenser 22. In operation, when the temperature of the external cold reservoir is lower than normal conditions, the liquid generated in the condenser 22 is rich in the higher boiling point liquid and hence, maximize the amount of heat rejected, the movable barrier 210 is configured to move towards the valve 208 to push more liquid rich in lower boiling point. Similarly, the liquid rich in higher boiling point is pulled back into the single chamber 204 through the opening of the valve 206 to keep the volume of the working fluid in the system constant. Similarly, when the temperature of the external cold reservoir is higher than normal conditions, the liquid generated in the condenser 22 is rich in the lower boiling point liquid and hence, to keep the amount of the working fluid constant, the movable barrier 210 is configured to move towards the valve 206 to push more liquid rich in higher boiling point. Similarly, the liquid rich in lower boiling point is pulled back into the single chamber 204 through the opening of the valve 208 to maximize the amount of heat rejected As shown in FIG. 6, a controller 224 is electrically coupled to the condenser 22 and the supply system 202 configured to provide the signals for the opening and closing of the valves 206, 208 and the movement of the movable barrier 210.

The systems and the methods described in the preceding sections can control the relative concentration of the higher and the lower boiling point liquids in the working fluid in a Rankine cycle. This allows the power generation systems to be operated at the optimum power output for a range of ambient temperature and heat source conditions. In some locations, the performance of the condenser in a Rankine cycle, such as an air-cooled condenser can be affected significantly by the temperature change between summer and winter. In desert climates, similar variations are observed between day and night. At many plants, the temperature of the external heat source may constantly vary due to a number of causes, including but not limiting to the change from full-load to part-load operation at power stations where waste-heat cycles are heated by turbine exhaust. By controlling the relative concentrations of the higher and the lower boiling point liquids in the working fluid, the instability of the power generation system is mitigated as the tendency of temperature variations to drive the plant's performance away from its design point is avoided.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for power generation using a Rankine Cycle, comprising:

a boiler connected to an inlet and an outlet, said boiler configured to receive heat from an external source and configured to receive a liquid stream through said inlet and to generate a vapor stream through said outlet, wherein said liquid stream comprises a mixture of a higher boiling point liquid and a lower boiling point liquid;

an expander configured to receive said vapor stream and to generate power and an expanded stream;

a condenser configured to receive said expanded stream and to generate said liquid stream; and a supply system coupled to said boiler or said condenser and configured to control relative concentration of said higher boiling point liquid and said lower boiling point liquid, wherein said supply system increases an amount of said higher boiling point liquid and decreases an amount of said lower boiling point liquid in said liquid stream being supplied to said inlet of said boiler when a temperature of said external source is below a nominal temperature, and wherein said supply system decreases an amount of said higher boiling point liquid and increases an amount of said lower boiling point liquid in said liquid stream being supplied to said inlet of said boiler when a temperature of said external source is above said nominal temperature.

2. The system of claim 1, wherein said supply system comprises a single chamber and a movable barrier situated in said single chamber and configured for separating a first fluid rich in said lower boiling point liquid and a second fluid rich in said higher boiling point liquid.

3. The system of claim 1, wherein said supply system comprises a first tank to hold a liquid rich in said higher boiling point liquid and a second tank to hold a liquid rich in said lower boiling point liquid.

4. The system of claim 1, wherein said liquid stream comprises at least two liquids selected from the group consisting of water, an alcohol and a hydrocarbon.

5. The system of claim 4 wherein said hydrocarbon is selected from the group consisting of pentane and propane.

6. The system of claim 4, wherein said alcohol comprises ethanol.

7. The system of claim 1, wherein said liquid stream comprises ethanol and water.

8. The system of claim 1, wherein said external source comprises at least one of a geothermal reservoirs, exhaust from a combustion systems, sola-rthermal reservoirs, hot fluids in or exiting from an industrial process, hot fluids from a combustion engine, heated gas from compression systems or fluids above atmospheric temperature generated by industrial processes.

9. A system for power generation using a Rankine cycle, comprising:

a boiler configured to receive heat from an external source and a liquid stream and to generate a vapor stream, wherein said liquid stream comprises a mixture of a higher boiling point liquid and a lower boiling point liquid;

an expander configured to receive said vapor stream and to generate power and an expanded stream;

a condenser configured to receive said expanded stream and generate said liquid stream; and a supply system coupled to one of said boiler or condenser and configured to control relative concentration of a mixture of a higher boiling point liquid and a lower boiling point liquid in said liquid stream, wherein said supply system comprises a first tank to hold a liquid rich in said higher boiling point liquid and a second tank to hold a liquid rich in lower boiling point liquid, and wherein said supply system increases an amount of said higher boiling point liquid and decreases an amount of said lower boiling point liquid in said liquid stream being supplied to said boiler when a temperature of said external source is below a nominal temperature, and wherein said supply system decreases an amount of said higher boiling point liquid and increases an amount of said lower boiling point liquid in said liquid stream being supplied to said boiler when a temperature of said external source is above said nominal temperature.

10. The system of claim 9, wherein said liquid stream comprises at least two liquids selected from the group consisting of water, alcohols, ketones, hydrofluorcarbons, and hydrocarbon.

11. The system of claim 10 wherein said hydrocarbon comprises one of cyclohexane, cyclopentane, butane, pentane and propane.

12. The system of claim 10, wherein said alcohol comprises ethanol.

13. The system of claim 9, wherein said liquid stream comprises ethanol and water.

14. The system of claim 9, wherein said external source comprises at least one of a geothermal reservoirs, exhaust from a combustion systems, solar- thermal reservoirs, hot fluids in or exiting from an industrial process, hot fluids from a combustion engine, heated gas from compression systems or fluids above atmospheric temperature generated by industrial processes.

15. A method of controlling a power generation system comprising a boiler configured to receive heat from an external source and configured to receive a liquid stream and to generate a vapor stream, an expander configured to receive said vapor stream and to generate an expanded stream, and a condenser configured to receive said expanded stream and to generate said liquid stream, the method comprising:

measuring a temperature of said external source;

comparing said measured temperature with a nominal temperature; and controlling relative concentration of a mixture of a higher boiling point liquid and a lower boiling point liquid in said liquid stream using a supply system coupled to said boiler or said condenser, whereby said supply system increases an amount of said higher boiling point liquid and decreases an amount of said lower boiling point liquid in said liquid stream being supplied to said boiler when said measured temperature of said external source is below said nominal temperature, and whereby said supply system decreases an amount of said higher boiling point liquid and increases an amount of said lower boiling point liquid in said liquid stream being supplied to said boiler when said measured temperature of said external source is above said nominal temperature.

16. The method of claim 15, wherein said liquid stream comprises at least two liquids selected from the group consisting of water, alcohols, ketones, hydrofluorcarbons, and hydrocarbon.

17. The method of claim 16 wherein said hydrocarbon comprises one of cyclohexane, cyclopentane, butane, pentane and propane.

18. The method of claim 16, wherein said alcohol comprises ethanol.

* * * * *